United States Patent [19]

Mishina

[11] 4,362,117

[45] Dec. 7, 1982

[54] MARINE STEERING GEAR WITH EMERGENCY STEERING MEANS

[75] Inventor: Haruhiko Mishina, Nagasaki, Japan

[73] Assignee: Mitsubishi Jukogyo Kabushiki Kaisha, Japan

[21] Appl. No.: 157,276

[22] Filed: Jun. 6, 1980

[30] Foreign Application Priority Data

Jun. 16, 1979 [JP] Japan ..... 54-76076

[51] Int. Cl.[3] ..... B63H 25/22

[52] U.S. Cl. ..... 114/150; 60/403; 91/509

[58] Field of Search ..... 114/144 R, 150; 244/78, 244/85; 180/132; 60/384, 385, 403, 404, 567; 91/509

[56] References Cited

U.S. PATENT DOCUMENTS 2,892,310 6/1959 Mercier ..... 114/150

3,112,901 12/1963 Kongelbeck ..... 114/150

4,209,986 7/1980 Cunningham ..... 114/150

*Primary Examiner*—Trygve M. Blix

*Assistant Examiner*—Sotelo Jesús D.

*Attorney, Agent, or Firm*—McGlew and Tuttle

[57] ABSTRACT

A marine steering gear equipped with an emergency steering means which comprises an emergency directional control valve capable of replenishing hydraulic fluid or oil to a plurality of pressure chambers of an actuator for a hydraulic steering engine through check valves and stop valves, and a relief valve designed to set a desired charge pressure and installed in lines of oil to be supplied through the directional control valve, check valves, and stop valves so as to forcibly reduce the air volumes in the pressure chambers and thereby hold the rudder blade substantially in a hydraulically locked state.

7 Claims, 2 Drawing Figures

MARINE STEERING GEAR WITH EMERGENCY STEERING MEANS

BACKGROUND OF THE INVENTION

Field of the Invention

This invention relates to a marine steering gear, and more specifically to a gear comprising both main and emergency steering means.

Conventional steering engines comprising actuators of the two-ram-four-cylinder type that include two or more power units (each composed of a hydraulic pump, a motor for driving the pump, etc.), the one-ram-two-cylinder type, or the rotary vane type are all devoid of hydraulic-pressure-replenishing means for emergency use. When any of the hydraulic pipe lines connected to the actuator, couplings, actuator packings, or the like has been seriously damaged, leakage of the hydraulic fluid or oil from the particular line or actuator will consequently take place. A delay in finding out or taking a proper step against the damage can lead to complete inability of steering the ship, with the oil tank of the power unit emptied.

To make matters worse, such a failure in the hydraulic system is likely to occur in heavy weather. When it happens, the rudder blade that is swamped by frantic waves is no longer hydraulically locked by the actuator, because of the loss of oil in the steering engine, but is beyond control at the mercy of the waves. Making a repair to the damage or recovering in such situation involves great danger. A lag in the recovery can result in a grave trouble that will decide the fate of the vessel.

SUMMARY OF THE INVENTION

It is an object of the present invention to provide a marine steering gear equipped with an emergency steering means which, in the event of a failure as above mentioned, can replenish the hydraulic fluid or oil to the actuator within a very short period of time to bring the rudder blade to an almost hydraulically locked state.

Another object of the invention is to provide a marine steering gear equipped with an emergency steering means which, after having brought the rudder blade to the almost hydraulically locked state, permits air bleeding from the actuator in a safe way to regain the steerability of the vessel.

Yet another object of the invention is to provide a marine steering gear equipped with an emergency steering means which is easy to handle and is highly dependable and efficient in operation.

These objects are realized in accordance with the present invention by a marine steering gear equipped with an emergency steering means which comprises an emergency directional control valve capable of replenishing hydraulic fluid or oil to a plurality of pressure chambers of an actuator for a hydraulic steering engine through check valves and stop valves, and a relief valve designed to set a desired charge pressure and installed in lines of oil to be supplied through the directional control valve, check valves, and stop valves so as to forcibly reduce the air volumes in the pressure chambers and thereby hold the rudder blade substantially in a hydraulically locked state.

The marine steering gear comprises a hydraulic steering engine actuator having a plurality of pressure chambers, and a main steering means. It also includes an emergency stearing means, which consists of an emergency pump unit, emergency oil lines connecting the pump unit with the pressure chambers, an emergency directional control valve installed in the lines to replenish oil to the pressure chambers through check valves and stop valves, and a charging relief valve capable of setting a desired charge pressure so as to forcibly reduce the air volumes in the pressure chambers and thereby hold the rudder blade substantially in a hydraulically locked state. The emergency directional control valve is one for charging use provided for the emergency oil lines.

In both figures, the main steering means of the known construction associated with the marine steering gear according to the invention is omitted by way of simplification.

DETAILED DESCRIPTION OF THE PREFERRED EMBODIMENTS

Preferred embodiments of the invention will now be described with reference to FIGS. 1 and 2.

Figure 1:
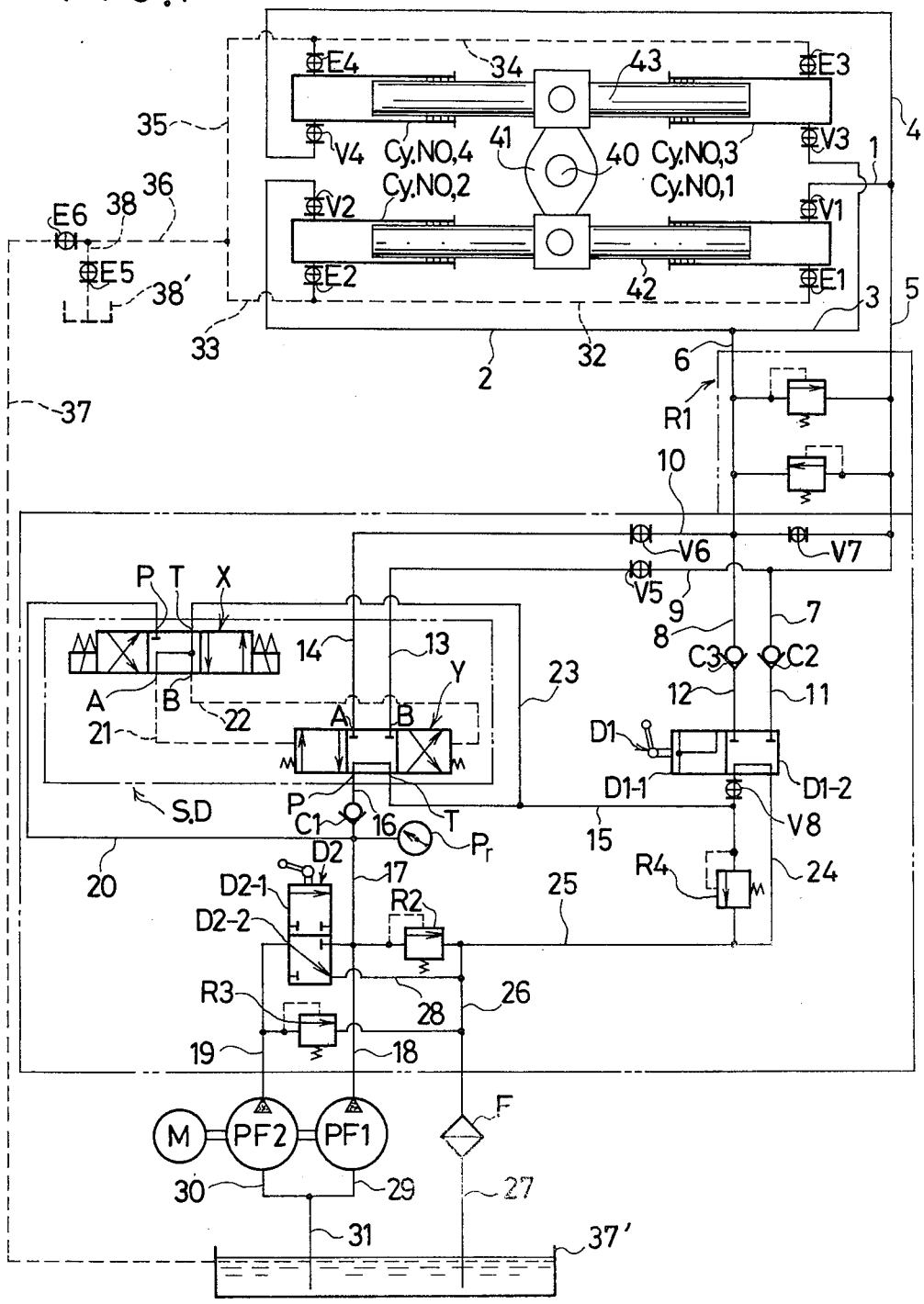
FIG. 1 is a hydraulic circuit diagram of a marine steering gear of the two-ram-four-cylinder type equipped with an emergency steering means embodying the invention.

In FIG. 1, the numeral 40 designates a stock for turning a rudder blade, and 41 a rudder crosshead mechanically coupled to the stock 40 so that the straight-line motion of rams 42, 43 can be converted to a rotary motion through the crosshead 41. Cy Nos. 1 to 4 stand for hydraulic cylinders for causing the rams 42, 43 to move straightly forward and backward.

The hydraulic cylinders Cy are provided with small-diameter oil passages or pipe lines 1–4 for emergency steering, aside from the main steering lines. Stop valves $V_1$–$V_4$ are installed on the respective lines 1–4, which in turn are connected with oil lines 5, 6 in communication with each other through a relief valve $R_1$. The stop valves $V_1$–$V_4$ are open only in the event of emergency steering.

A hand-operated directional control valve $D_1$ for charging is provided to replenish the working fluid or oil to the hydraulic cylinders. The valve $D_1$ and the oil lines 5, 6 are connected via lines 7, 8, 11, 12. Between the pairs of lines 7, 8 and 11, 12 are installed, respectively, check valves $C_2$, $C_3$. The directional control valve $D_1$ has two working positions, one providing a charging circuit $D_1$-1 and the other a bypass circuit $D_1$-2.

The symbol S.D. stands for a solenoid-operated directional control valve consisting of a solenoid-operated valve X and a pilot-operated valve Y. This valve S.D. can replace the hand-operated directional control valve, when necessary.

Ports A, B of the pilot-operated valve Y are communicated, respectively, with the oil passages or lines 5, 6 through lines 13, 14, stop valves $V_5$, $V_6$, and lines 9, 10. A bypass valve $V_7$ is provided for bypassing the lines 5, 6.

Another port P of the valve Y leads to a pump PF1 of a double pump unit for emergency pumping via an oil line 16, check valve $C_1$, and lines 17, 18. The last port T opens through a line 15, stop valve $V_8$, return oil lines 24, 25, 26, 27 of the hand-operated directional control valve $D_1$ for charging, and filter F, into an oil tank 37'. Between the lines 15 and 25 is mounted a charging relief valve $R_4$.

Pilot lines 21, 22 of the pilot-operated valve Y are connected with ports A, B of the solenoid-operated valve X. Another port P of the valve X leads through a line 20 to a line 17 at a point short of the check valve $C_1$. In this way the cracking pressure of the check valve $C_1$ provides a hydraulic pressure high enough to actuate the pilot-operated valve Y. The last port T of the solenoid-operated valve X opens to a line 23, which is united at the opposite end with the line 15.

A line 19, connected to the delivery side of the other pump PF2 of the double pump unit driven by a single motor M, leads to the line 17 by way of a hand-operated directional control valve $D_2$. When the valve $D_2$ is in a $D_2$-2 position, the delivery line 19 is in communication through a bypass line 28 with the return line 26 for the tank 37'.

Between the lines 17 and 26 is installed a relief valve $R_2$ for the pump PF1, and between the lines 19 and 26 a relief valve $R_3$ for the pump PF2. When the hand-operated directional control valve $D_2$ is in the $D_2$-1 position, the relief valve $R_2$ can serve the both pumps PF1 and PF2.

The pumps PF2 and PF1 draw up the working fluid or oil from the oil tank 37' through suction lines 31, 30, 29. The oil tank 37' for the emergency pump unit holds a sufficient quantity of oil to make up for any loss of the liquid from the steering engine actuator.

The hydraulic cylinders Cy Nos. 1-4 are equipped, respectively, with air bleeder valves $E_1$-$E_4$, which in turn are communicated with an oil tank 38' for the main steering pump unit through air bleeder lines 32-36 and 38 and a stop valve $E_5$, and are also communicated with the oil tank 37' for the emergency pump unit through a stop valve $E_6$ and an air bleeder circuit 37.

Although the main steering hydraulic circuit is not shown, it should, of course, be clear to those skilled in the art that the circuit of a known type is provided in parallel with the emergency hydraulic circuit illustrated and described above.

It is now assumed that a main steering oil line leading to the hydraulic cylinders Cy Nos. 1-4 has been seriously damaged and the oil has leaked, out of the main oil tank and the steering piping system including those cylinders, into the steering engine room, with the rudder blade no longer kept under control but left at the mercy of violent waves. The procedure then to be followed to start emergency steering will be described below.

(1) First stage (replenishment of oil)

At this stage, for immediate cutoff of the communication between the damaged part and the hydraulic cylinders Cy Nos. 1-4, the stop valves (not shown) installed in the main steering oil lines leading to the hydraulic cylinders (or sometimes installed on those cylinders themselves) are closed, and the stop valves $V_1$-$V_4$ for emergency steering are opened.

Next, the directional control valve $D_1$ is turned to the bypass position $D_1$-2 and the directional control valve $D_2$ to the charging position $D_2$-1, and then the emergency motor M is switched on. As soon as the running of the motor M has stabilized at a constant speed, the hand-operated valve $D_1$ for charging is shifted to the charging position $D_1$-1, so that charging is started by the pumps PF1 and PF2. At this time the rudder blade is being tossed about by the frantic waves, but the oil is charged in the direction toward the pressure chamber most receptive of it, without resisting the violent movement of the blade.

The space inside each of the hydraulic cylinders Cy Nos. 1-4 is initially for the most part occupied by air. As each cylinder is charged with oil, the air in the space is compressed by the charge pressure until its volume sharply decreases to the equivalent of the charge pressure. Of course, the check valves $C_2$, $C_3$ keep the oil, once charged into the cylinder, from escaping to the outside.

Thus, about the time when the charge pressure becomes equal to the setting pressure of a relief valve $R_4$, the movement of the rudder blade is sharply reduced to the degree corresponding to the volume of air under the charge pressure. The blade is now almost completely locked hydraulically. Upon arrival of the charge pressure at the level equivalent to the setting pressure of the relief valve $R_4$, the operation proceeds to the next stage.

(2) Second stage (air bleeding)

After the rudder blade has been hydraulically locked by closing the stop valves $V_1$, $V_2$ of the cylinders Cy Nos. 1, 2, the air bleeder valves $E_3$, $E_4$ of the cylinders Cy Nos. 3, 4 are opened to begin air bleeding of the latter two cylinders. During this, the directional control valve $D_1$ for charging is kept in the position $D_1$-1.

Following the conclusion of air bleeding, the air bleeder valves $E_3$, $E_4$ and stop valves $V_3$, $V_4$ of the cylinders Cy Nos. 3 and 4 are closed. Next, the stop valves $V_1$, $V_2$ of the cylinders Cy Nos. 1, 2 are opened simultaneously with the opening of the air bleeder valves $E_1$, $E_2$ to bleed the cylinders Cy Nos. 1, 2.

After the air bleeding of the cylinders Cy Nos. 1, 2, only the air bleeder valves $E_1$, $E_2$ are closed and the stop valves $V_3$, $V_4$ are opened while the stop valves $V_1$, $V_2$ are kept open, and the hand-operated directional control valve $D_1$ for charging is reset to the position $D_1$-2.

If the oil quantity in the oil tank 37' for the emergency pump unit is found insufficient at any time during the air bleeding, the oil being flown out by the air bleeding should be directed back to the emergency oil tank 37' by closing the stop valve $E_5$ and opening the stop valve $E_6$.

(3) Third stage (emergency steering)

The stop valves $V_5$, $V_6$ are opened and the solenoid-operated valve X is shifted, either under electric non-followup control or manually in the steering engine room, by a steersman or quartermaster in the steering engine room or bridge, while watching the telltale or helm indicator. In this manner communication is established between the port P of the pilot-operated valve Y and either port A or B of the valve to effect the on-off control of the steering engine in the port or starboard direction.

In this case the stop valve $V_8$ is kept open. The speed of the ship should be controlled so that the pressure generated in any of the cylinders Cy Nos. 1-4 is not greater than the setting pressure of the relief valve $R_3$.

The operation with a two-ram-four-cylinder type actuator has so far been described. In case when the actuator works merely as a one-ram-two-cylinder type, for example, when a packing of the cylinder Cy No. 3 has been damaged or when the No. 3 cylinder cannot be disconnected from the damaged piping due to omission of stop valves from the main steering lines on the hydraulic cylinders, the operation will be as described below.

(1) First stage (replenishment of oil)

The stop valves (not shown) of the main steering oil lines for the cylinders Cy Nos. 1, 2 that can be used are closed while, at the same time, the main steering lines for the cylinders Cy Nos. 3, 4 are set to the bypass state by opening bypass valves (not shown). In this state, only the stop valves $V_1$, $V_2$ are opened while the stop valves $V_3$, $V_4$ for emergency steering are kept closed, and the hand-operated directional control valve $D_1$ is shifted to the charging position $D_1$-1 to charge oil into the cylinders Cy Nos. 1, 2. The directional control valve $D_2$ is kept in the $D_2$-1 position.

When the charge pressure has become equal to the setting pressure of the relief valve $R_4$, the unfettered movement of the rudder blade at the mercy of the rough sea markedly decreases. Therefore, the directional control valve $D_1$ is returned to the $D_1$-2 position, the stop valve $V_8$ is closed, and the stop valves $V_5$, $V_6$ are opened.

(2) Second stage (air bleeding)

Upon completion of the afore-described preparations, the hand-operated directional control valve $D_2$ is shifted to the $D_2$-2 position to allow the oil delivered from the pump PF2 to take a bypass route and, immediately following this, the solenoid-operated valve X is gradually manoeuvered by hand to open the air bleeder valves $E_1$, $E_2$ to effect air bleeding. Throughout the bleeding period the stop valve $V_8$ is kept closed, and a constant back pressure is maintained in the return line 15 by the charge-pressure-setting relief valve $R_4$. Consequently, the possibility of the rudder blade being violently moved by the residual air in the cylinders is avoided, and air bleeding can be safely accomplished.

(3) Third stage (emergency steering)

After the air bleeding, the stop valve $V_8$ is opened and, while the hand-operated directional control valve $D_2$ is being held in the $D_2$-2 position, single side steering is performed by the stroke of the ram in the hydraulic cylinders Cy Nos. 1, 2. This steering is carried out by switching the solenoid-operated valve X either by remote electrical control from the bridge or steering engine room or by hand in the steering engine room.

In this case, the oil entering the cylinders Cy Nos. 1, 2 is delivered by only the pump PF1 and therefore the oil pressure is approximately double. Hence even though the speed of the vessel remains the same as that with the two-ram-four-cylinder actuator, there will be no deficiency of the motor power.

Where some other part than packings of the hydraulic cylinders is damaged, the rudder blade can be hydraulically locked by use of some jury means such as blind flanges, even when the damaged part cannot be disconnected from the cylinders by the stop valves of the main steering lines. Alternatively, a temporary bypass circuit may be provided by means of quick joints or the like, dispensing with the stop valve $V_8$.

Figure 2:
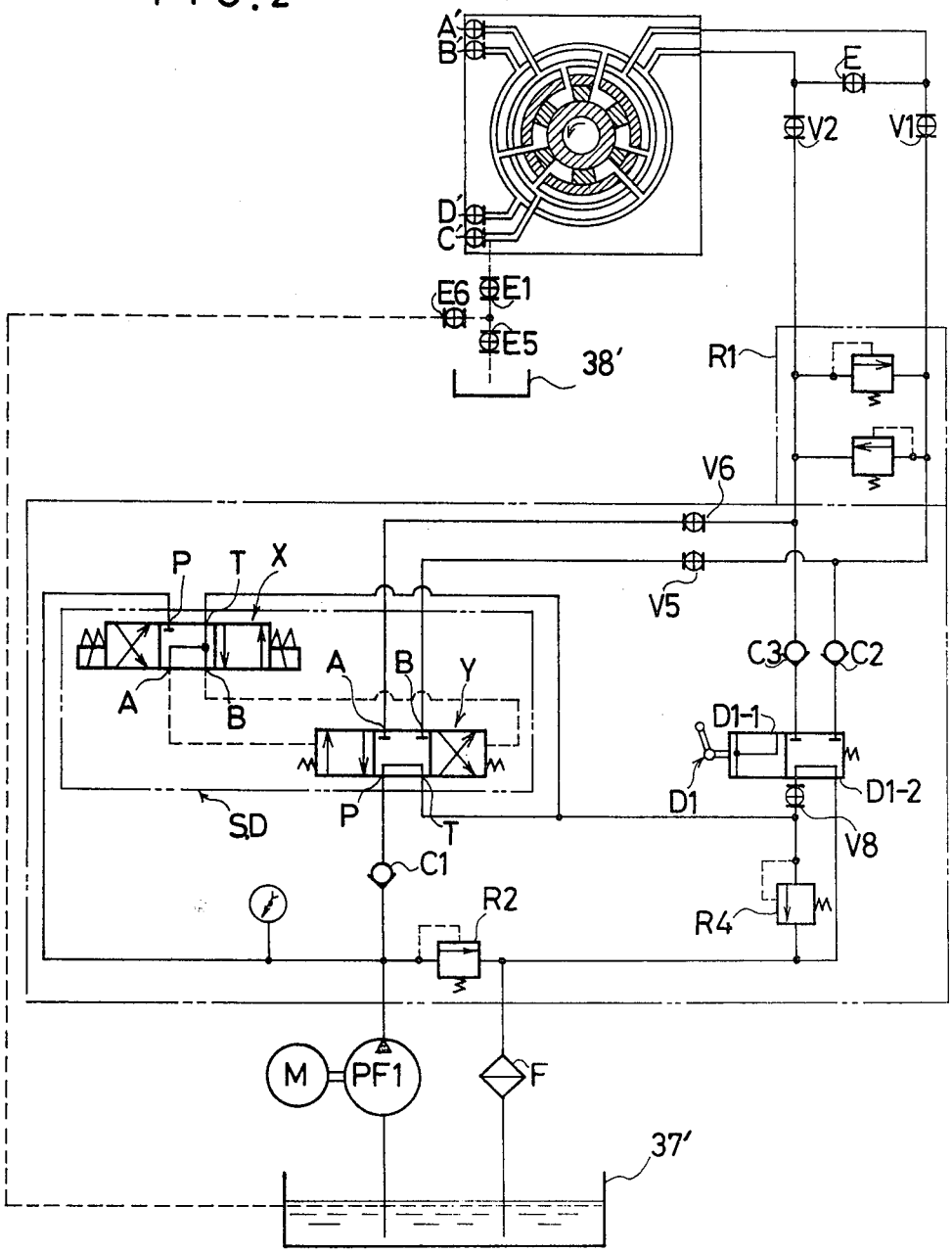
FIG. 2 is a hydraulic circuit diagram of a marine steering gear of the rotary vane type equipped with an emergency steering means embodying the invention.

FIG. 2 illustrates a preferred embodiment of a marine steering gear equipped with an emergency steering means according to the invention, in which the actuator is of the rotary vane type.

The emergency steering means shown may be satisfactorily employed with the one-ram-two-cylinder type actuator as well.

Basically, this emergency steering means is the same as that shown in FIG. 1, but it has two major distinguishing features, viz., the use of a single pump instead of the double pump unit of the preceding embodiment and the omission of the hand-operated directional control valve $D_2$ and the relief valve $R_3$. With a steering engine using an actuator of the one-ram-two-cylinder or rotary vane type, or an engine which gives no alternative of the actuator to be chosen, there is no necessity of the double pump unit and hence the hand-operated valve $D_2$ and the relief valve $R_3$.

The emergency steering means shown may be operated in the same way as the means of FIG. 1 when the latter works with only one ram and two cylinders due to an accident.

In the figure, the symbols A', B', C', D' designate air bleeder valves, and other symbols and numerals designate parts like or similar to those shown in FIG. 1.

The advantages derivable from the apparatus of the invention are as follows:

(1) While the rudder blade is moving uncontrollably at the mercy of raging waves, oil from the oil tank 37' of the emergency pump unit can be promptly charged to the pressure chambers of the steering engine actuator.

(2) There is provided a hydraulic circuit for simultaneously charging oil from the pump to the port and starboard pressure chambers (Cy Nos. 1–4) of the steering engine actuator via check valves $C_2$, $C_3$. A relief valve $R_4$ is also provided to give a predetermined charge pressure to each of the pressure chambers.

Consequently, even when the rubber blade is being tossed about by frantic waves, oil is replenished to the pressure chamber most readily receptive of it, without resistance to the movement of the rudder blade. Charging is thus accomplished by a motor with a minimum power output. Suitable setting of the charge pressure renders it possible to reduce the air volume in each pressure chamber to a minimum because of its compressibility and thereby bring the rudder blade to an almost hydraulically locked state. Hence the air bleeding from the actuator can be safely carried out.

(3) The emergency pump unit is made up of a fixed delivery pump, and the directional control valve S.D. for emergency steering is composed of a solenoid-operated valve X and a pilot-operated valve Y. With these arrangements the steering engine actuator can be operated by either direct electric control from the steering engine room or bridge or by manual control in the steering engine room. Thus, it is possible to operate the steering engine actuator so that the rudder works, for example, up to an angle of 15 degrees to the left or right within a period of 60 seconds at the ship's velocity of seven knots or half the maximum speed, whichever is the higher.

(4) Since the pump unit may consist of a double-delivery pump or two pumps driven by a single motor, the capability defined in (3) above can be fully displayed with a minimum motor power requirement, in either one-ram or two-ram operation (including single- or double-action operation of a double-acting cylinder or cylinders, when employed). At the start of operation, the delivery lines may be bypasses to the tank by switching the charging directional control valve $D_1$ to the bypass position. This permits no-load starting and the use of an emergency dynamo with the minimum of capacity needed.

(5) Where only an actuator for moving the rudder toward only a given direction is available, as with the steering engine having a one-ram-two-cylinder or rotary vane type actuator, the stop valve $V_8$ is closed to cause the oil on its way back to the tank to pass through the charging relief valve $R_4$. In this manner the actuator for the steering engine is operated under a constant back pressure (equivalent to the charge pressure set by the relief valve), and therefore air bleeding from the actuator can be easily and safely carried out while keeping the rudder blade from moving at the mercy of waves.

Some embodiments of the present invention will be briefly outlined below;

(1) A marine steering gear equipped with an emergency steering means is provided which includes a hydraulic circuit capable of rapidly replenishing the hydraulic fluid or oil to the pressure chambers (hydraulic cylinders or rotary vane chambers) of the steering engine actuator through check valves $C_2$, $C_3$ up to a charge pressure suitably set by a relief valve $R_4$ designed for setting the charge pressure, the circuit having a hand-operated directionaly control valve $D_1$ for the charging use, single-stroke switching of which renders it possible to forcibly reduce the air volume in the actuator through the agency of the charge pressure and hold the rudder blade in an almost hydraulically locked state.

(2) A marine steering gear equipped with an emergency steering means is provided which includes a stop valve $V_8$ installed between the hand-operated directional control valve $D_1$ and a line 15 for the oil returning to the pump to ensure the return of the oil always through the charge-pressure-setting relief valve $R_4$, whereby air bleeding is easily and safely carried out for the one-ram-two-cylinder or rotary vane type steering engine or for the two-ram-four-cylinder type steering engine in which one set of cylinders is unusable, that is, in the situation which otherwise makes the bleeding impossible with the rudder blade hydraulically locked as in the preceding embodiment.

(3) A marine steering gear equipped with an emergency steering means is provided which includes a double-delivery pump unit PF1, PF2 (or two pumps) connected to a single motor, a low-pressure relief valve $R_3$ which is used where the combined delivery of the two pumps is needed, and a high-pressure relief valve $R_2$ which is used where the delivery of either pump alone is needed, either of said pumps being bypassed, where necessary, by a hand-operated directional control valve $D_2$ to the oil tank. This arrangement is intended to minimize the drive motor power and the dynamo capacity required, because, as compared with the employment of the total cylinders as of the two-ram-four-cylinder type steering engine, the use of only a set of cylinders necessitates a mere half of the pump delivery the former requires to maintain the same steering velocity, even though the latter needs a doubled hydraulic pressure at the same speed of the ship.

(4) A marine steering gear equipped with an emergency steering means is provided which includes, in addition to the arrangements set forth in (1) to (3) above, a fixed delivery pump and a (solenoid- or hand-operated) directional control valve, whereby on-off control of the steering engine actuator from the bridge or steering engine room is made possible.

It is to be understood that the embodiments of the invention set forth in (1) through (4) above, of course, comprises a main steering means of any type known to the art, in addition to the emergency steering means.

I claim:

1. An improved marine emergency steering system for controlling a fluid operated marine steering device, the steering device being of the type having a hydraulic steering engine and an actuator for actuating the steering engine, the actuator having a plurality of pressure chambers, and emergency steering means of the type having a hydraulic steering system for passing a hydraulic fluid to the plurality of pressure chambers, the improvement comprising a delivery pump, discharge line means for passing the hydraulic fluid from said delivery pump to the pressure chambers, a check valve mounted in said discharge line means at a location downstream of said delivery pump for checking back flow of the hydraulic fluid in a direction toward said delivery pump, a first relief valve mounted in said discharge line means, said first relief valve being operable to relieve hydraulic fluid from the discharge line means, a steering-directional control valve mounted in said discharge line means intermediate said check valve and the pressure chambers, an oil-charge-directional control valve mounted in said discharge line means intermediate said steering-directional control valve and the pressure chambers, said oil-charge-directional control valve having two working positions and being operable to shift between a first one of said working positions in which fluid received from said delivery pump is passed to the pressure chambers and a second one of said working positions in which fluid received from said delivery pump is not passed to the pressure chambers, oil-charge check valves mounted intermediate said oil-charge-directional control valve and the pressure chambers for checking back flow of the hydraulic fluid in a direction toward said oil-charge-directional control valve, a second relief valve mounted in said discharge line means upstream of said oil-charge-directional control valve to relieve hydraulic fluid from said discharge line means at a set pressure corresponding to a desired charge pressure to forcibly reduce air volume in the pressure chambers, said discharge line means downstream of said steering-directional control valve comprising a first separate line including said oil-charge-directional control valve and a second separate line excluding said oil-charge directional control valve, both of said first and second separate lines being connected to the pressure chambers, and said steering-directional control valve being operable to alternately pass fluid received from said delivery pump through said discharge line means to the pressure chambers indirectly through said oil-charge-directional control valve and directly by by-passing said oil-charge-directional control valve.

2. An improved marine emergency steering system according to claim 1 including stop valves mounted between said oil-charge-directional control valve and the pressure chambers.

3. An improved marine emergency steering system according to claim 1, wherein said first relief valve is installed upstream of said steering-directional control valve.

4. An improved marine emergency steering system according to claim 1, wherein the emergency steering system includes a tank including a reservoir of the hydraulic fluid, a suction line connected between said tank and said delivery pump, and further comprising a second directional control valve for emergency steering installed in said discharge line means upstream of said second relief valve, said second directional control valve being operable to supply one of the pressure chambers on one of the port and starboard side while the hydraulic fluid from the other pressure chamber is forced back to the tank through said steering-directional control valve and said second relief valve, and further comprising a stop valve installed in said second separate line.

5. An improved marine emergency steering system according to claim 4, wherein said delivery pump comprises two pumps, and said discharge line means includes a delivery line of one of said two pumps being connected to a delivery line of the other of said two pumps via said second directional control valve.

6. An improved marine emergency steering system according to claim 1, wherein the actuator is of a two-ram-four-cylinder type.

7. An improved marine emergency steering system according to claim 1, wherein the actuator is of a rotary vane type.

* * * * *